US011735155B2

(12) United States Patent
Putkis et al.

(10) Patent No.: US 11,735,155 B2
(45) Date of Patent: Aug. 22, 2023

(54) METHOD FOR GENERATING PARAMETRIC SOUND AND MEANS FOR CARYING OUT SAID METHOD

(71) Applicant: UAB Neurotechnology, Vilnius (LT)

(72) Inventors: Osvaldas Putkis, Vilnius (LT); Gailius Vanagas, Panevezys (LT); Marius Mikolajunas, Panevezys (LT); Darius Virzonis, Panevezys (LT)

(73) Assignee: UAB Neurotechnology, Vilnius (LT)

( * ) Notice: Subject to any disclaimer, the term of this patent is extended or adjusted under 35 U.S.C. 154(b) by 186 days.

(21) Appl. No.: 17/260,260

(22) PCT Filed: Aug. 3, 2018

(86) PCT No.: PCT/IB2018/055860
§ 371 (c)(1),
(2) Date: Jan. 14, 2021

(87) PCT Pub. No.: WO2020/026005
PCT Pub. Date: Feb. 6, 2020

(65) Prior Publication Data

US 2021/0264894 A1 Aug. 26, 2021

(51) Int. Cl.

| | |
|---|---|
| ***H04R 1/02*** | (2006.01) |
| ***G10K 15/02*** | (2006.01) |
| ***H04R 19/01*** | (2006.01) |

(52) U.S. Cl.
CPC ..... *G10K 15/02* (2013.01); *H04R 19/013* (2013.01); *H04R 2217/03* (2013.01)

(58) Field of Classification Search
CPC ..... H04R 29/001; H04R 29/003
USPC ..... 381/59, 89, 332
See application file for complete search history.

(56) References Cited

U.S. PATENT DOCUMENTS

| | | | | |
|---|---|---|---|---|
| 5,550,923 | A * | 8/1996 | Hotvet | A61F 11/14 381/103 |
| 9,002,043 | B2 | 4/2015 | Norris | |
| 9,667,173 | B1 | 5/2017 | Kappus | |

(Continued)

OTHER PUBLICATIONS

International Search Report and Written Opinion dated Jul. 10, 2019 for PCT Application No. PCT/IB2018/055860.

*Primary Examiner* — George C Monikang
(74) *Attorney, Agent, or Firm* — Meunier Carlin & Curfman LLC

(57) ABSTRACT

The present invention discloses a method for producing parametric sound using parametric sound system which is based on ultrasonic electrostatic transducers. It comprises modulation of a carrier ultrasonic signal with a processed audio signal in audio signal processor comprising adaptive frequency filtering based on the audio signal level, dynamic range compression, square root operation, amplification of the modulated ultrasonic signal using a D-class amplifier, driving an electrostatic transducer and generating modulated ultrasonic waves into the air. The electrostatic transducer for the parametric sound system comprises a specific back plate structure that improves electromechanical efficiency of the transducer and also enables realization of a phased array on a single back plate. The disclosed manufacturing method of the electrostatic transducer comprises producing sets of electrodes on the surface of the back plate forming individual cells.

9 Claims, 7 Drawing Sheets

(56) References Cited

U.S. PATENT DOCUMENTS

| | | | | |
|---|---|---|---|---|
| 2012/0051556 | A1* | 3/2012 | Pompei | G10K 15/02 381/77 |
| 2015/0104026 | A1 | 4/2015 | Kappus | |
| 2015/0109880 | A1* | 4/2015 | Kim | G01S 7/52017 367/7 |
| 2016/0057525 | A1 | 2/2016 | Kappus | |
| 2016/0227329 | A1* | 8/2016 | Pompei | H04R 3/00 |

* cited by examiner

METHOD FOR GENERATING PARAMETRIC SOUND AND MEANS FOR CARYING OUT SAID METHOD

FIELD OF THE INVENTION

The present invention relates to field of parametric sound generation and in particular to a method for generating a parametric sound, a parametric sound system for generating such parametric sound, ultrasonic electrostatic transducers for such a system for generation of ultrasonic waves and method for production of such ultrasonic electrostatic transducers.

BACKGROUND OF THE INVENTION

Parametric sound is produced when ultrasonic waves modulated with audio signal demodulate while travelling in air. As ultrasonic waves have lower diffraction when compared to audio frequency waves, parametric system allows transmitting sound in a narrow beam. This enables creating localized regions where the sound can be heard but is diminished elsewhere. Applications of parametric sound are ranging from personalized audio systems and targeted advertising down to relieving symptoms of tinnitus.

The non-linear nature of the demodulation process requires audio signal preprocessing to invert the non-linear effect so that reproduced sound has low distortion. The preprocessing usually includes a square root operation but more complex inversion schemes can also be used. While sound quality of parametric sound systems have improved over the years there are some fundamental limitations. Parametric systems lack bass response as demodulation process acts as a natural high pass filter. While equalizer can be applied to flatten the frequency response, it comes at an expense of the diminished overall volume of reproduced sound. This is due to the fact that the maximum achievable sound volume by parametric sound systems is limited by the maximum safe ultrasonic wave pressure level that humans can be exposed to. Hence, its application where high volume sound reproduction is needed, say, music concerts, is unfeasible. Parametric systems are also unlikely to compete with Hi-Fi/Hi-End systems primarily due to its poor bass response.

Closest prior art of parametric audio system is disclosed in U.S. Pat. No. 8,027,488. One embodiment of the system includes splitting the modulated signal to two frequency ranges and driving two different sets of transducers so that a wider frequency range can be transmitted into the medium. This adds unnecessary complexity in terms of transducer realization and signal processing as electrostatic transducers can have a very wide frequency bandwidth. Moreover, demodulation process favors high frequency components, therefore attenuation of high frequency components by transducer response gives some frequency equalization of the overall system. Other embodiments of the system include an audio preprocessing step that integrates the incoming audio signal, which is an attempt to enhance the bass response. As already mentioned, this comes at the expense of reducing the overall sound volume of reproduced parametric sound as large amplitude ultrasonic waves will be needed, which has an upper safety limit for human exposure.

Commonly, piezoelectric or electrostatic transducers are used in parametric sound systems. Piezoelectric transducers typically offer higher output pressure levels but have lower bandwidth when compared to electrostatic transducers.

Moreover, piezoelectric transducers are relatively small and, as large aperture speakers are required for parametric sound systems in order to achieve high quality and volume sound, the number of required piezoelectric transducers becomes very large increasing the cost of such a parametric sound system. Due to these reasons electrostatic transducers are more often encountered in the designs of parametric sound systems.

Typically an electrostatic transducer is composed of a flexible polymer membrane that rests on a back plate. The conductive back plate usually has V-shaped grooves. The back plate provides support for the membrane and also acts as an electrode. The flexible membrane has a metalized conductive top layer. A polymer layer provides insulation between the membrane's top conductive surface and the back plate. When a DC biased electrical signal is applied between membrane and the back plate, the membrane moves towards or away from the back plate due to electrostatic forces and related spring forces arising from the membrane's elasticity. Each groove together with the membrane forms a single transducer cell. Essentially, the transducer is created out of many small cells all vibrating in sync. It is worth noting, that efficiency of such transducer depends on a groove profile, which, for example can be rectangular, V-shaped, U-shaped or elliptical. Parts of the back plate that are closest to the membrane (the tips of the grooves) have the largest influence on the membrane's movement, whilst the parts that are farthest (the bottom of the groove) have little impact. Hence, only certain parts of the back plate contribute to the attraction of the membrane which leads to low efficiency. In addition, cells of such transducers cannot be controlled individually as they all share same electrodes. Hence, no matter their design transducers sharing the same back plate cannot be used as phased array systems and their pressure field characteristics are fixed and cannot be controlled electronically. A phased array system, when used in parametric sound system, can be used to control the shape and beam of ultrasonic pressure field and hence the direction/localization of reproduced parametric sound.

Closest prior art for an electrostatic transducer is disclosed in U.S. Pat. No. 9,002,043. It comprises a back plate having plurality of protuberant elements on which a flexible layer is disposed so that there is a volume of air in between each two protuberant elements and the flexible layer, forming cells. Like a typical electrostatic transducer it suffers from low efficiency as some parts of the back plate (acting as an electrode) contribute more to the movement of the membrane than the others depending on the cell's depth profile. In addition, the back plate of the disclosed transducer also serves as a common electrode for all cells and hence the transducer cannot be used as a phased array system and consequently the direction and/or shape ultrasound beam cannot be controlled electronically.

A manufacturing method of a typical electrostatic transducer is disclosed in international application No PCT/US2004/027620. The method includes preparing a back plate member having an array of parallel ridges extending along the one axis and spaced apart along the perpendicular axis at predetermined separation distances. The ridges support an electrically sensitive and mechanically responsive film with one side of the film being captured at the film contacting faces so that sections of the film are disposed between the parallel ridges. The film contacting faces mechanically isolate each of the sections of the film from adjacent sections. The back plate as disclosed is usually micro machined or casted from aluminum or other conductive metal. Main drawback of such method is high transducer's cost, particularly when manufacturing a small quantity of transducers. In addition, such a method is not suitable for manufacturing electrostatic transducers with high electromechanical efficiency.

The invention solves above mentioned shortcomings of the prior and provides further advantages such as improving overall bass performance of a parametric sound system, maximizing volume of reproduced sound given the limit on ultrasound pressure level, improving electromechanical efficiency of electrostatic transducers used in parametric sound systems and allowing to manufacture low cost and easily customizable transducers.

BRIEF SUMMARY OF THE INVENTION

The present invention discloses a method for producing parametric sound using parametric sound system which is based on ultrasonic electrostatic transducers. The method comprises steps of modulating a carrier ultrasonic signal with a processed audio signal, audio signal processing involving steps of adaptive frequency filtering based on the audio signal level, increasing the bass response at low amplitudes, increasing loudness of the reproduced sound, square root operation in order to invert the non-linear demodulation process. Further steps include amplifying the modulated ultrasonic signal and driving an electrostatic transducer, which may be preceded by a high-frequency coil at a series-resonance, for generating modulated ultrasonic waves.

A system for producing an audible parametric sound comprises audio signal processor, ultrasonic signal generator, modulator, optional high-pass filter, D-class amplifier and an electrostatic transducer. The system may further comprise a high-frequency coil connected in series with the transducer. The coil together with the electrostatic transducer forms a series-resonant circuit which helps to increase driving voltage for the transducer. This enables the use of standard D-class audio amplifiers that operate at lower voltages and are designed for driving low-impedance inductive loads.

The invention also discloses an electrostatic transducer for the parametric audio system. It comprises a specific back plate structure that improves electromechanical efficiency of the transducer and also enables realization of a phased array on a single back plate. The back plate of the transducer comprises one or more cells wherein each cell of the transducer comprises multiple electrodes. Each cell comprises two side electrodes onto which a membrane is rested and an optional central electrode. Each cell of the transducer can be driven separately creating a phased array on a single back plate. By individually controlling driving phases and/or amplitudes of the array cells, the direction and shape of the ultrasound beam can be controlled.

A manufacturing method of the electrostatic transducer is also disclosed. The method comprises etching conductive traces on a fibre-reinforced polymer substrate which has at least one surface deposited with conductive material, such as copper. The substrate provides mechanical support for components of the transducer. Solder paste is deposited onto conductive traces using a solder mask. The solder paste is then made to reflow forming convex profiles on the traces thus forming protuberant electrodes. These protuberant electrodes perform a function of both—electrodes and mechanical support for the membrane. Convex geometry of the electrodes may be self-formed when solder metal is heated up to the melting temperature. The exact geometry depends on the electrode dimensions, surface tension, wetting angle and amount of deposited solder paste.

BRIEF DESCRIPTION OF DRAWINGS

The features of the invention believed to be novel and inventive are set forth with particularity in the appended claims. The invention itself, however may be best understood by reference to the following detailed description of the invention, which describes exemplary embodiments, given in non-restrictive examples, of the invention, taken in conjunction with the accompanying drawings, in which:

Preferred embodiments of the invention will be described herein below with reference to the drawings. Each figure contain the same numbering for the same or equivalent element.

DETAILED DESCRIPTION OF THE INVENTION

Figure 1:
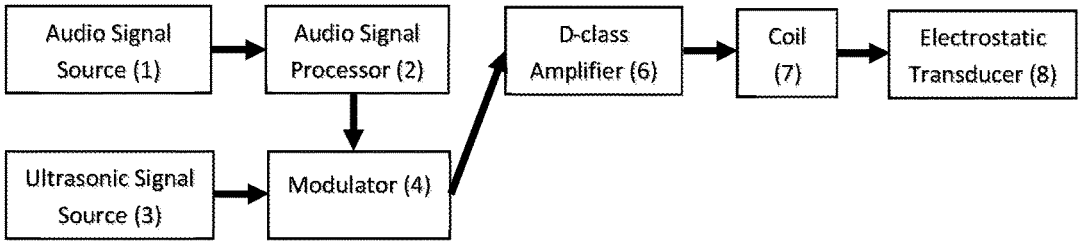
FIG. 1-3 shows various embodiments of parametric audio system according to the invention.
Figure 2:
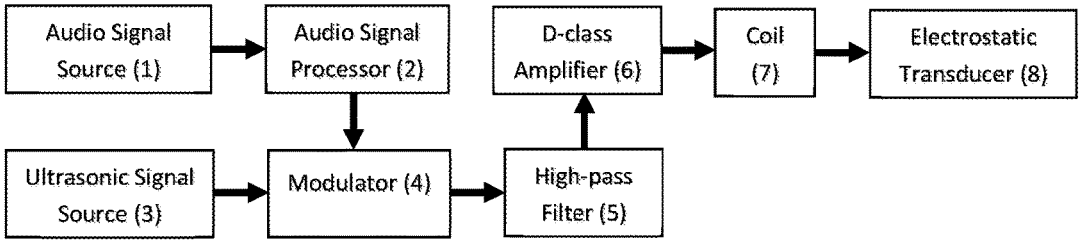

FIGS. 1 and 2 shows embodiments of parametric audio system according to the invention. One embodiment of the system according to the invention comprises audio signal input means (1), an audio signal processor (2), an ultrasonic signal generator (3), a modulator (4), a D-class amplifier (6), high-frequency coil (7) and ultrasonic electrostatic transducer (8). According to another embodiment the system according to previous embodiment further comprises a high-pass filter (5), which ensures that only ultrasonic frequencies are passed to amplifier (6) and hence only ultrasonic frequency are transmitted by transducer (8). The high frequency coil (7) may be absent from both above embodiments.

Figure 3:
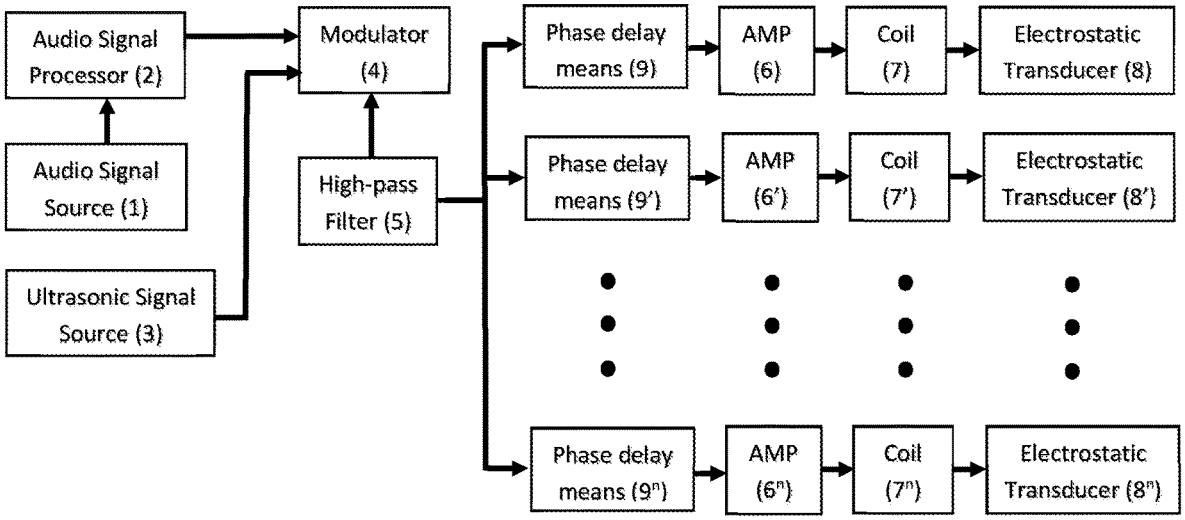

FIG. 3 shows another embodiment of the invention that implements a phased array parametric sound system. The system comprises audio signal input means (1), an audio signal processor (2), an ultrasonic signal generator (3), a modulator (4), the optional high-pass filter (5), multiple phase delay means (9, 9', 9$^n$), multiple D-class amplifiers (6, 6', . . . 6$^n$), multiple high-frequency coils (7, 7', . . . 7$^n$) associated with the multiple ultrasonic electrostatic transducers (8, 8', . . . 8$^n$). D-class amplifier is denoted as AMP in FIG. 3. The high frequency coils (7, 7', . . . 7$^n$) may be absent from such embodiment.

A typical D-class amplifiers used in non-parametric audio systems amplify signals up to 100V peak-to-peak. This is not sufficient for driving electrostatic transducers that typically need voltages in excess of 200V peak-to-peak. Moreover, the electrostatic transducer (T, 8, 8', . . . 8$^n$) appears as a capacitive load to the amplifier (6, 6', . . . 6$^n$) with high impedance, while non-parametric audio amplifiers are designed to work with inductive low-impedance loads. Hence, it is problematic to use integrated solutions of D-class amplifiers for driving electrostatic transducers. In order to overcome these issues, a coil (7, 7', . . . 7$^n$) is introduced in the circuit, which is connected in series with electrostatic transducer (8, 8', . . . 8$^n$)—a capacitive load, creating a series-resonant circuit. The inductance of the coil (7, 7', . . . 7$^n$) is chosen such that the resonance frequency coincides with ultrasonic carrier frequency. The operation at resonance allows increasing the voltage swing across the transducer (8, 8', . . . 8$^n$) up to 300V and more with amplifier operating only with 50-100V power supply. Moreover, the impedance of series-resonant circuit is lowest at resonant frequency, hence the circuit appears as a low impedance load to the amplifier (6, 6', . . . 6$^n$). The circuit's resonance is characterized by the inductance and resistance of the coil (7, 7', . . . 7$^n$), capacitance and impedance of the transducer (8, 8', . . . 8$^n$) and hence these parameters should be considered carefully to ensure that there is enough voltage gain at the transducer and at the same time there is enough bandwidth left to reproduce distortionless sound. As the switching frequency of D-class amplifier (6, 6', . . . 6$^n$) should be very high (on the order of 100 kHz), specialized coil made from multistrand wires (such as litz wire) should be used. The coil made out of a single strand wire will have a large resistance for such a high switching frequency due to skin effect. This will result in weaker resonance and huge losses in the coil manifesting in unnecessary heating.

It should be also noted that as with any electrostatic transducer a DC bias need to be applied to the transducer. The typical DC bias for ultrasonic electrostatic transducers is typically in the 200-500V range. In order to prevent this DC voltage from damaging the amplifier (6, 6'; . . . 6$^n$), a coupling capacitor should be placed in between the amplifier (6, 6', . . . 6$^n$) and the transducer (8, 8', . . . 8$^n$).

Figure 4:
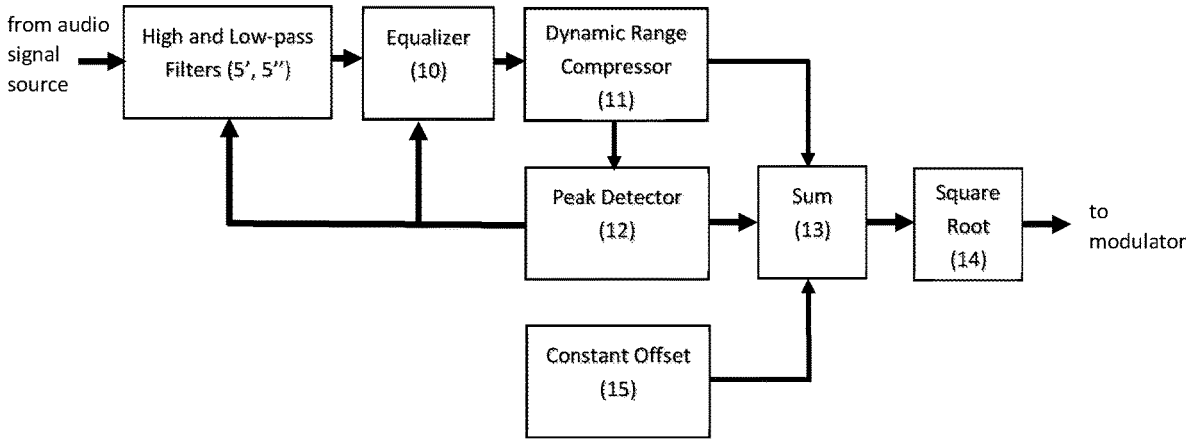
FIG. 4 shows a schematic diagram of audio signal processor.
Figure 5:
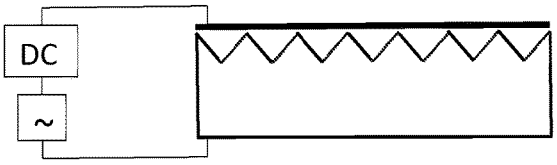
FIG. 5 shows a schematic diagram of a prior art electrostatic transducer with V-grooved back plate.

FIG. 4 shows an audio signal processor (2) having common structure for all embodiments of the system. The sound processor (2) is used for distortion compensation caused by a non-linear demodulation process of modulated ultrasonic waves and for improving maximum achievable reproduced sound volume and the overall bass response of the parametric system. The audio signal in the signal processor (2) firstly passes through a high-pass filter (5') and, optionally, a low-pass filter (5"). The high-pass filter (5') is used to remove low frequency content from audio signal that cannot be reproduced by parametric sound system due to inherent high-pass filtering of demodulation process. This removal is done before subsequent preprocessing steps so that low frequency content does not affect them negatively such as dynamic range compression by dynamic range compressor (11) which increases the volume of perceived sound. The optional low-pass filter is used to remove high frequency content from audio signal (above 5-15 kHz) that cannot be reproduced by parametric system due to limited bandwidth of ultrasonic transducers. While electrostatic transducers generally have a large bandwidth, the square root operation used in audio signal processing creates higher order harmonics and the signal bandwidth increases considerably even if the bandwidth of original audio signal is relatively small. Again, the removal of high-frequency content should be done before subsequent processing steps. An equalizer (10) is then used to compensate for frequency response of various components of the system such as for example, coil (7)—electrostatic transducer (8) resonant circuit. It can also be used to emphasize certain frequencies, for instance, if the system is specifically designed for voice broadcasting, frequencies of 300-3000 Hz could be emphasized that are most important in voice recreation.

The high-pass filter (5') and/or low-pass filter (5") and/or equalizer (10) of the audio signal processor (2) are adaptive: their parameters change depending on the audio signal level, which can be detected using a peak detector (12) or other signal level detector. Feedback from the peak detector (12), used for adaptive amplitude control in the system, is used in this case as shown in FIG. 4. Most importantly, the cut-off frequency or other parameters of the high-pass (5') filter is adjusted depending on the amplitude of audio signal. When the amplitude of audio signal is low the high-pass filter (5') allows more low frequency components to pass, improving the bass response of the system. When the amplitude of audio signal is high, more of the low frequency components are filtered out, decreasing the bass response of the system but allowing for sound volume to increase without violating the safe ultrasound pressure level. Instead of using a feedback from the peak detector (12), another peak detector or other audio signal level detector (not shown) could be placed at the input of audio signal processor and used to estimate audio signal level which in turn will regulate filter and/or equalizer parameters. After frequency content adjustments, the dynamic range of the signal is reduced using the compressor (11), i.e. the high-volume sound in the audio signal is reduced and low-volume sound increased. This results in increased loudness of the reproduced sound without increase in the maximum amplitude of audio signal and subsequently modulated ultrasonic signal, which has to be limited in order to maintain human-safe operation of the system. Moreover, as signal compression reduces dynamic range of the signal, square root operation is sufficient to invert the non-linear demodulation process to obtain sound of low distortion and more elaborate inversion functions are not needed that cope with signal having a wide range of amplitudes. The audio signal is then shifted to only positive values, because the audio signal typically consists of harmonic signals that sweep through positive and negative values, so that square root operation in square root operation means (14) can be performed. For this purpose, the peak detector (12) is used to detect peaks in the audio signal and add these peak values to the audio signal in the summing means (13) making it only hold positive values. Peak detector (12) reacts quickly to increasing amplitude in audio signal ensuring that after the addition the signal is positive, but decays slowly when amplitude is decreasing in audio signal. While the peak detector (12) will not generate a 'perfect' envelope as the algorithm described in U.S. Pat. No. 7,596,228, the peak detector (12) offers a real-time and less-complex implementation at a cost of small amount of wasted ultrasonic power. An additional small constant offset, produced in offset generation means (15), may also be added to audio signal, which slightly reduces the modulation depth from the maximum to reduce distortion of reproduced sound and also ensure that no over-modulation occurs in rare instances when the peak detector (12) is not able to keep up with rapidly increasing amplitude in audio signal. The square root is then taken from this composite positive signal by the square root operation means (14).

The use of the peak detector (12) also results in an adaptive amplitude control: when there is no audio signal the amplitude of the modulated ultrasonic signal will be also at minimum and no/little energy will be radiated into the medium and when the audio signal is present the modulated ultrasonic signal will be increased to a required level so that over modulation does not occur. The peak detector (12) can also provide the signal level value to the adaptive frequency filters (5', 5") and/or equalizer (10) that in turn change the frequency response of the system depending on the signal level. As previously mentioned, the bass response is increased when the audio signal decreases. In such a case the modulated signal power will not decrease proportionally to the audio signal because the modulated signal level will contain more low frequency components.

In all embodiments the ultrasonic signal generator (3) produces a single-frequency ultrasonic signal which is then modulated with a preprocessed audio signal. The DSB modulator (4) is simply a multiplication of ultrasonic single-frequency signal with a preprocessed audio signal. It is worth noting that for Single Sideband (SSB) modulation the square root operation is not necessary, however SSB modulation leads to lower volume of reproduced sound, therefore the present invention relies only on Double Sideband (DSB) modulation, which requires for square root operation.

If after modulation the signal is fed to the optional high-pass filter (5), the optional high-pass filter (5) is used to ensure that lower sideband of DSB modulation does not extend into audible or close to audible frequencies (because square root operation used in audio signal preprocessing introduces higher order harmonics which increases the bandwidth of the signal significantly).

Another embodiment of the parametric sound system according to the invention may further comprise (not shown) visual feedback component such as a video camera in combination to any of the above embodiments. The video camera can be used, for example, to detect presence of a person or other relevant object. After a person or other relevant object is detected the parametric sound system would start transmitting relevant information. The camera can also be used for identification of a person and/or his/her specific features in order to convey information specific to certain person or his/her features. Therefore, the localized sound reproduction by parametric sound system with the visual feedback can offer solutions in personalized advertising, personalized entertainment, greeting services, passenger flow control in airports (directing passengers to their terminals, gates) and etc.

Furthermore, the beam of parametric sound system can be controlled and targeted to a detected person's location. The beam control can be achieved either by using a phased array system or by using mechanical actuators to physically move/rotate the speaker to direct it to required location.

In yet another embodiment, further to any above embodiments, a simple distance measurement component, based on for example ultrasonic or optical methods, can be used to provide information of a distance from parametric sound system part realized as a parametric speaker to a target object such as human. This distance measurement could be used to adjust the pressure level of modulated ultrasonic waves, so that when a person is near the speaker, the level is reduced to keep it under safe operation limits and when a person is further away the level is increased. This would allow maintaining the maximum achievable sound volume irrespective of the listener's position.

Figure 6A:
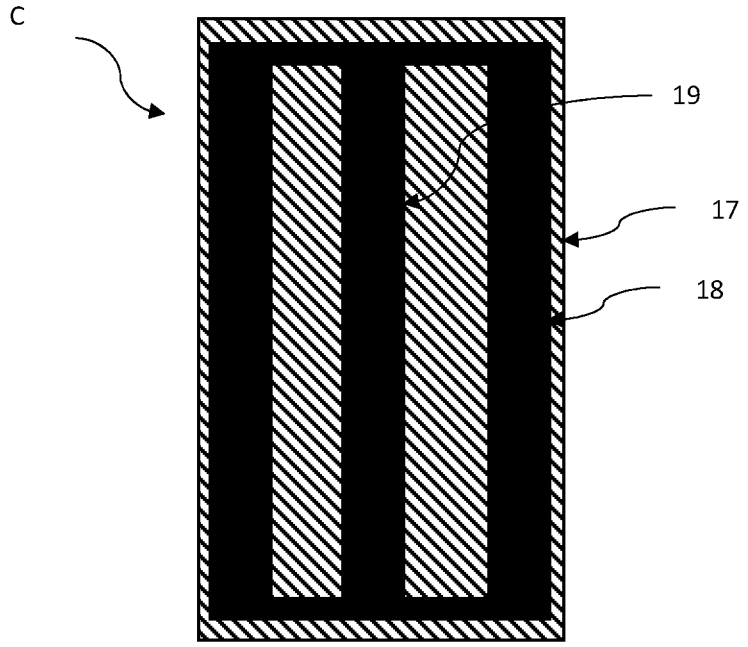
FIG. 6*a* shows top view of a single cell of the electrostatic transducer, where central and support electrodes are interconnected above a solid back plate.
Figure 6B:
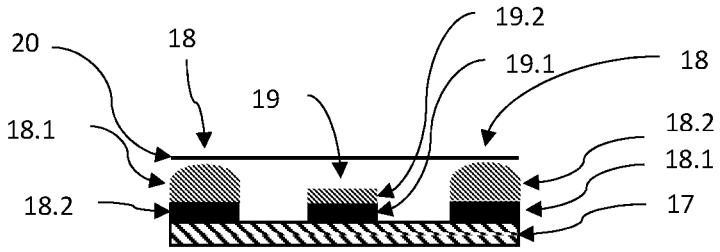
FIG. 6*b* shows cross-section of a single cell of electrostatic transducer, where central and supporting electrodes are interconnected above a solid back plate.

According to another aspect of the invention FIGS. 6*a* and 6*b* show front and cross-section schematic views of a single cell (C) of embodiment of an electrostatic transducer (T) according to the invention which can be used in any embodiments of the parametric sound system as described above. The cell (C) comprises a solid back plate region (17), wherein, for example, the back plate is made out of a non-conductive material such as glass reinforced polymer; support electrodes (18), having a base part (18.1) and which may have a convex-shaped top parts (18.2); a central electrode (19), having a base part (19.1) and which may have a top part (19.2); and a flexible membrane region (20), that has a conductive top surface (not shown), wherein the membrane region (20) can, for example, be made out of PET (Polyethylene terephthalate) and conductive top surface metalized, for example, with aluminum or gold. Each support electrode (18) comprises a base (18.1) that, for example, can be made out of copper, gold, aluminum or other conductive metal and a convex-shaped top part (18.2) on top of the base (18.1), which can be made, for example, from a conductive material, such as solder metal. The central electrode (19) comprises a base (19.1), similar to support electrode's (18) base (18.1), which can be coated with a layer of a conductive material, such as solder metal, or left uncoated. The central electrode (19) in all cases has lower height than support electrodes (18).

It should be understood that materials used for the transducer (T) manufacture have been given here as examples and appropriate substitutes can be used instead. In addition, the back plate and the flexible membrane are continuous for entire transducer (T) and term "region" only denotes a certain area of the continuous back plate and the continuous flexible membrane associated with a single cell (C). The metalized top surface of the membrane, i.e. opposite the surface of the membrane that touches the support electrodes (18), acts as a top electrode of the transducer (T). The support electrodes (18) and the central electrode (19) should be understood as being bottom electrodes.

The support electrodes (18) provide support for the membrane region (20). A gap is formed between the membrane region (20) and the central electrode (19) of the cell (C). The central electrode (19) is electrically interconnected with both support electrodes (18). The bottom electrodes (18, 19) are interconnected at their ends as shown in FIGS. 6*a* and 6*b* on the upper face (21) of the back plate region. The bottom electrodes (18, 19) can also be interconnected at the bottom face (22) of the back plate region using through back plate connections (23), as shown in FIGS. 7*a* and 7*b*, which prevents the connections having any effects on the electromechanical structure of the transducer (T) or influence, for example, solder metal deposition process on the bases (18.1, 19.1) of bottom electrodes (18, 19).

In another embodiment the support electrodes (18) of the cell (C) are not interconnected with the central electrode (19) (not shown) of the cell (C) and can be driven separately i.e. applying larger bias voltage and/or ultrasonic signal to the central electrode (19) with respect to supporting electrodes (18) of each cell (C). This results in electrodes contributing more equally to the attraction/repulsion of the membrane, which improves transducer's overall efficiency.

Figure 7A:
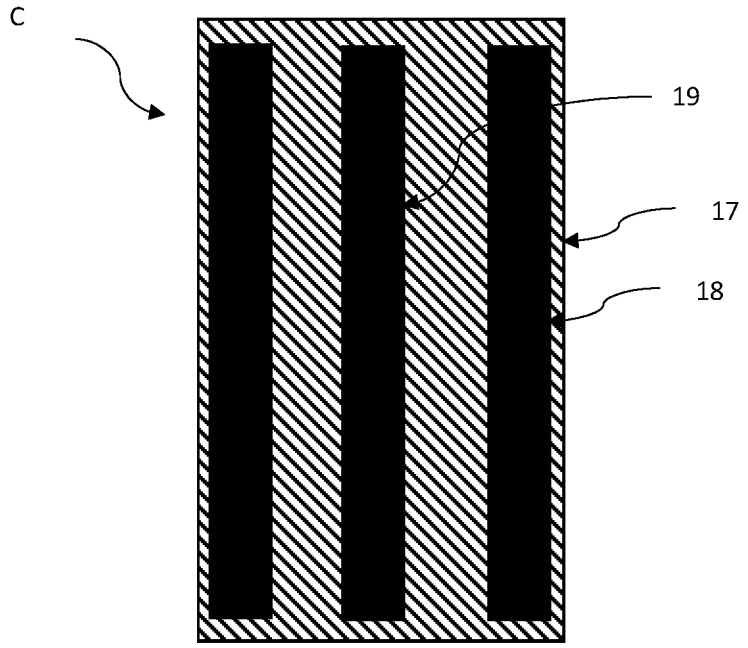
FIG. 7*a* shows top view of a single cell of electrostatic transducer according to the invention, where central and supporting electrodes are interconnected below a solid back plate.
Figure 7B:
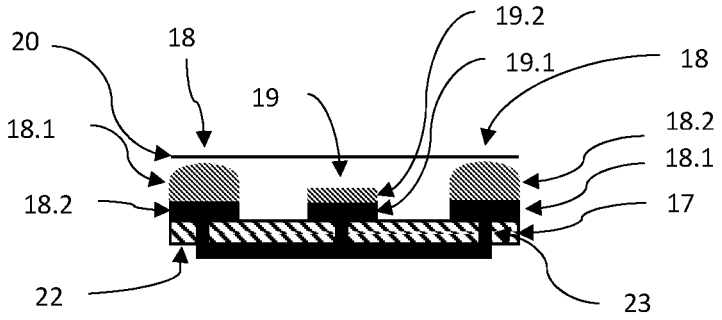
FIG. 7*b* shows cross-section of a single cell of electrostatic, where central and supporting electrodes are interconnected below a solid back plate.
Figure 8A:
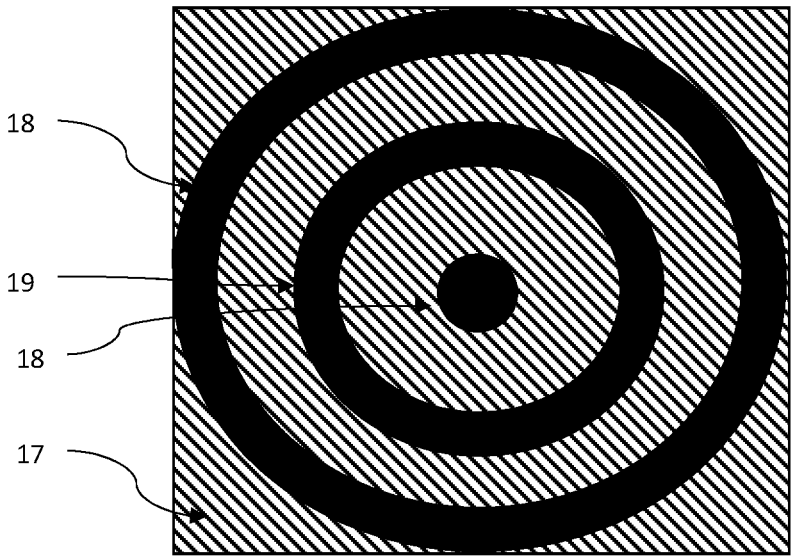
FIG. 8*a* shows top view of a single cell of electrostatic transducer having a ring-like arrangement of the electrodes.
Figure 8B:
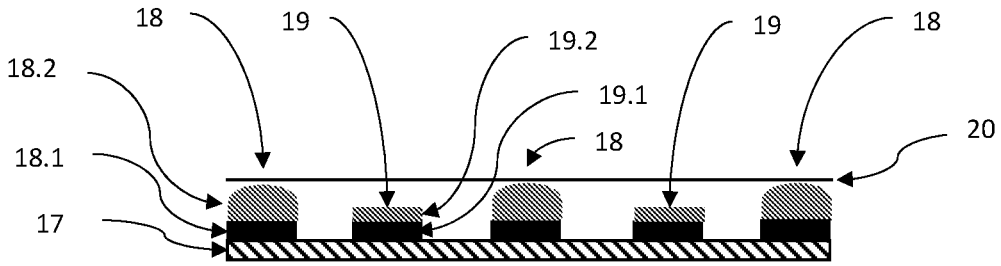
FIG. 8*b* shows cross-section of a single cell of electrostatic transducer having a ring-like arrangement of the electrodes.

The cell (C) shown schematically in FIGS. 6*a* and 7*a* has bottom electrodes (18, 19) arranged in parallel lines forming a rectangular cell (C). However other arrangements are possible such as the one shown in FIGS. 8*a* and 8*b*, where the bottom electrodes (18, 19) are arranged in concentric rings forming a circular cell.

As an example, the following electrode dimensions can be used for transducer that would efficiently operate in 40-80 kHz frequency range: the central electrode's (19) width is 0.2 mm, the supporting electrodes' (18) width is 0.6 mm, radius of the convex shaped top part of support electrodes (18) formed by deposited solder metal is 0.3 mm and the width of the whole cell is 1.2 mm. A PET membrane in this case should be around 6 micrometres in thickness.

Figure 9A:
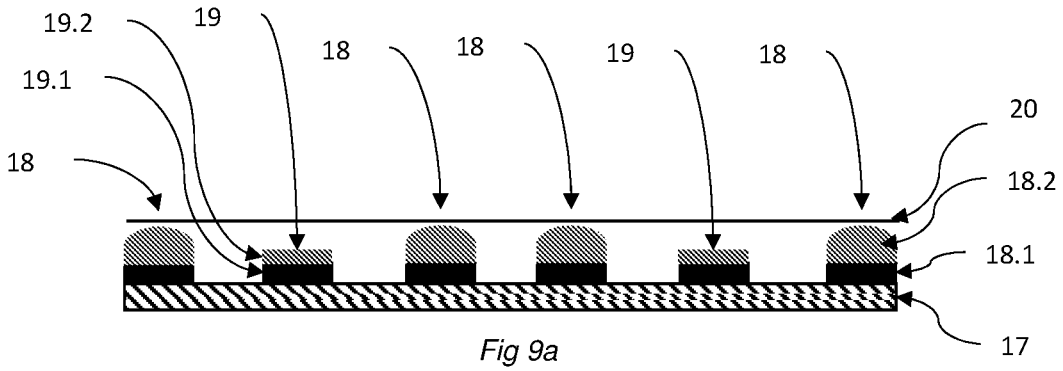
FIG. 9*a* shows multiple cells of the transducer having separate sets of support electrodes for each cell.

According to one example of arrangement of support electrodes (18) in the cell (C) of the transducer (T) each cell (C) has a set of two support electrodes (18) as shown if FIG. 9*a*. According to another example of arrangement of support electrodes (18) in the cell (C) of the transducer (T) each support electrode (18) of each cell (C) is a common support electrode (18) between two adjacent cells as shown if FIG. 9*b*.

Advantage of the transducer with shared support electrodes (18) is that larger area of the membrane region (20) vibrates and hence transducer works more efficiently than in case of FIG. 9*a* realization, given the same transducer area. The transducer comprising cells (C) with separate support electrodes (18) allows driving each cell (C) separately.

Figure 9B:
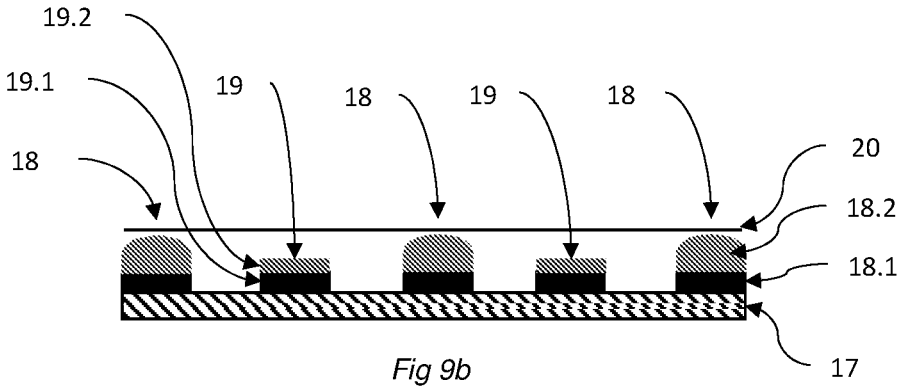
FIG. 9*b* shows multiple cells of the transducer with cells sharing support electrodes.

A combination of arrangements of FIGS. 9*a* and 9*b* can also be used: groups of cells (C) can be separated without sharing support electrodes (18), while within the groups the cells (C) would share support electrodes (18).

Figure 10A:
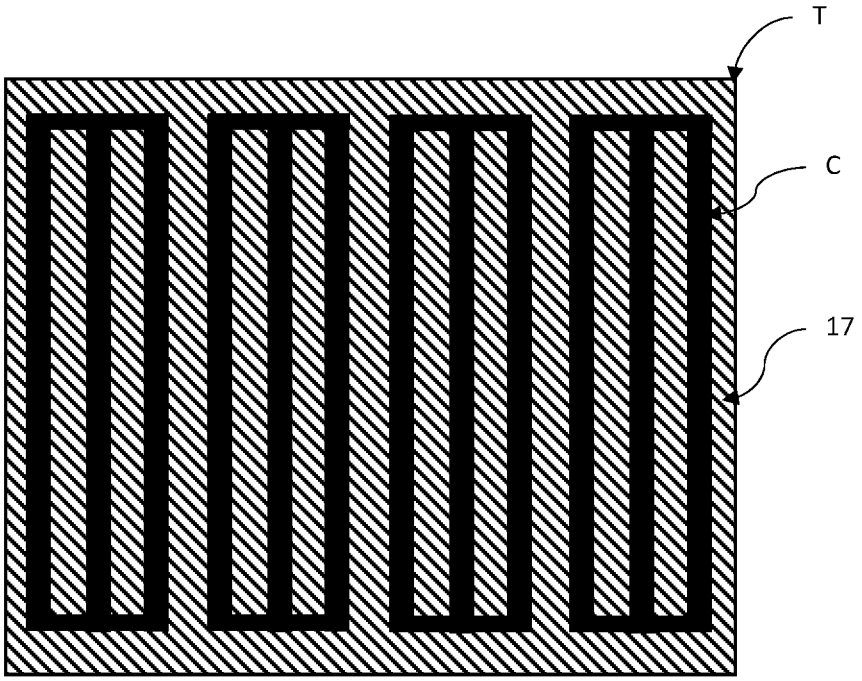
FIG. 10*a* shows an implementation of 1D ultrasonic array.
Figure 10B:
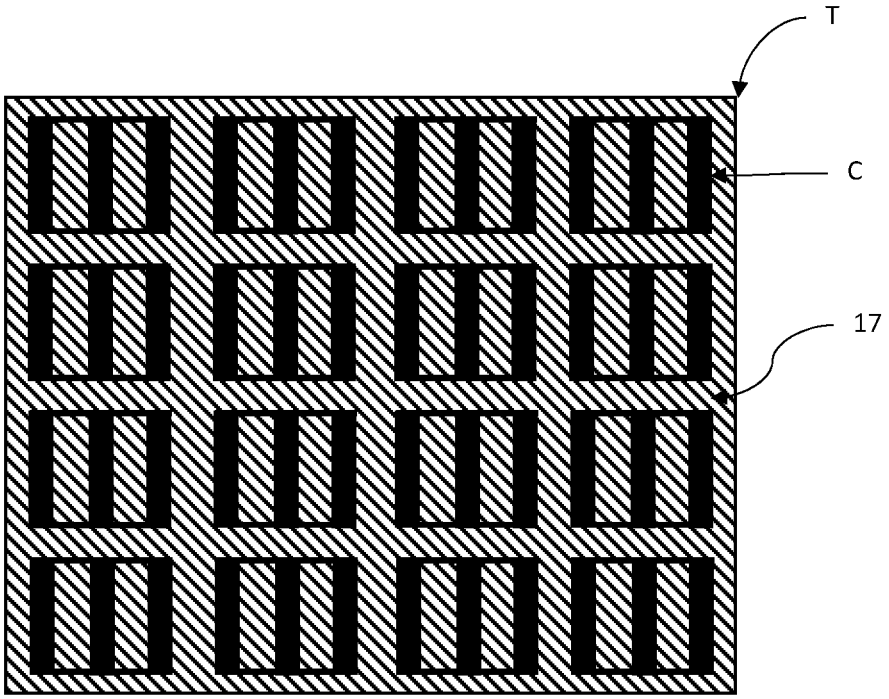
FIG. 10*b* shows an implementation of 2D ultrasonic array.

The transducer having bottom electrodes (18, 19) electrically isolated for each cell (C) as described has an additional advantage over conventional transducers that have a common bottom electrode: a phased array system can be implemented on a single back plate (17) wherein cells (C) or groups of cells act as phased array elements Examples of implementations of 1D and 2D arrays are shown in FIGS. 10*a* and 10*b* respectively: each cell (C) has a separate set of electrodes (18, 19) and hence each cell (C) can be driven individually. By controlling frequency/amplitude/phase of each cell (C), the ultrasonic field focusing, ultrasonic beam steering and other field manipulations can be performed with high precision and efficiency. When such control is implemented in a parametric speaker it is possible to control the sound localization, i.e. focus the sound in certain region in space, steer the sound beam, etc.

Further, manufacturing method of an electrostatic ultrasonic transducer (T) according to the invention is disclosed.

Each base (18.1, 19.1) of each bottom electrode (18, 19) of each cell (C) of the transducer (T) are machined or chemically etched on a fiber reinforced polymer substrate with a metalized surface. Convex cross-section profile is formed for bottom support electrodes (18) by depositing solder paste on the base (18.1) of the support electrodes (18) using solder mask. The solder mask is then removed and the entire transducer (T) is evenly heated up to the solder melting temperature to initiate the reflow process. This results in self-forming of a naturally convex-shaped layer of solder metal. After removal of heat the solder metal solidifies preserving a convex profile. The support electrodes (18) with a convex-shaped profile performs a function in transducer (T) of both: electrode and a mechanical support for the membrane. The exact geometry formed by solder metal using reflow process depends on the dimensions of the base (18.1, 19.1) of the bottom electrode (18, 19), surface tension, wetting angle and amount of deposited solder metal. These have to be carefully chosen in order for the convex geometry to be formed. The amount of deposited solder paste generally depends on the solder mask used in the deposition process, while surface tension and wetting angles depend on the solder paste properties and temperature used for reflow process. It is worth noting, that for consistent deposition results temperature temporal profile during reflow process is important and guidelines for specific solder paste should be followed. The central electrode (19) can be coated with a layer of solder metal, gold or other or left uncoated.

As an example, in order to form the support electrodes (18) with cross-section profile close to a semi-circular one, the solder mask of 120 micrometer thickness has to be used for deposition of solder paste on the copper trace that has a width of 0.6 mm. The solder paste content should be Sn62Pb36Ag2 with 12% flux content. The maximum temperature in the reflow process should be around 210° C.

Although the above description discloses manufacturing of the transducer (T) having certain configuration of electrodes, it should be understood that said method is not restricted to manufacturing of transducers having this particular configuration of electrodes. The method is suitable for manufacturing electrostatic traducers having an unrestricted arrangement and/or dimensions for the electrodes and an unrestricted number of electrodes in each cell of the transducer. Furthermore, convex cross-section profile can be formed for some or all bottom electrodes. For instance, each cell can have only the support electrodes (18) with convex-shaped top part and no central electrode (19).

The proposed manufacturing method also offers easy-to-implement customizations and allows to realize transducers (T) or phased arrays where cells (C) can have different dimensions and different distributions. This enables tuning transducer's or phased array's acoustic performance.

The back plate of the transducer (T) can also integrate all the associated driving electronics of the transducer. The electronic components in this case should be placed on the opposite face of the back plate with respect to the bottom electrodes (18, 19) of the transducer (T) cells (C). Due to the transducer being naturally thin and its integration with electronics, overall products (such as parametric sound system) can have small dimensional footprints, leading to reduced manufacturing costs of casings, opening new design possibilities, etc.

'Top', 'Bottom', 'Above' and 'Below' as used in the text only refer to the position of something as shown in the presented drawings.

'Audio' or 'Audible' as used in the text refers to something having a frequency content that lies in range of 20 Hz-20 kHz.

'Ultrasonic' as used in the text refers to signals or waves having a frequency larger than 20 kHz.

The invention claimed is:

1. An electrostatic transducer comprising:

a back plate;

a membrane; and multiple electrically driven cells, wherein each cell comprises multiple bottom electrodes, wherein at least two of said bottom electrodes are support electrodes and said support electrodes have a convex shaped top part.

2. The electrostatic transducer according to claim 1, wherein the multiple bottom electrodes of each cell are support electrodes and a central electrode.

3. The electrostatic transducer according to claim 1, wherein the support electrodes are shared between each two consecutive cells.

4. The electrostatic transducer according to claim 1, wherein each cell has individual set of support electrodes.

5. The electrostatic transducer according to claim 1, comprising an array of cells or groups of cells that are independently drivable.

6. The electrostatic transducer according to claim 1, wherein each cell has support electrodes and a central electrode that are independently drivable.

7. A method for producing an electrostatic transducer according to claim 1, wherein the back plate is formed from an electrically non-conductive material and each support electrode of each cell is formed on the surface of the back plate by depositing an electrically conductive base and an electrically conductive top part.

8. The method according to claim 7, wherein a central electrode for each cell is formed on the surface of the back plate by depositing an electrically conductive base.

9. The method according to claim 8, wherein each central electrode of each cell is further provided with an electrically conductive top part.

* * * * *